US007516630B2

(12) United States Patent
Kim et al.

(10) Patent No.: US 7,516,630 B2
(45) Date of Patent: Apr. 14, 2009

(54) WASHING MACHINE

(75) Inventors: Jong Seok Kim, Changwon-si (KR); Yang Hwan No, Changwon-si (KR); Han Ki Cho, Changwon-si (KR); Youn Su Jung, Changwon-si (KR); Jung Hoon Kang, Changwon-si (KR); Myung Sik Park, Changwon-si (KR); Young Hoon Ha, Mason-si (KR)

(73) Assignee: LG Electronics Inc., Seoul (KR)

( * ) Notice: Subject to any disclaimer, the term of this patent is extended or adjusted under 35 U.S.C. 154(b) by 798 days.

(21) Appl. No.: 10/629,715

(22) Filed: Jul. 30, 2003

(65) Prior Publication Data

US 2004/0025544 A1 Feb. 12, 2004

(30) Foreign Application Priority Data

Jul. 30, 2002 (KR) ..... 10-2002-0045088
Jul. 30, 2002 (KR) ..... 10-2002-0045090

(51) Int. Cl.
*D06F 39/08* (2006.01)

(52) U.S. Cl. ..... 68/183; 68/196

(58) Field of Classification Search ..... 68/183, 68/196; 134/207, 198; 239/222.11, 223
See application file for complete search history.

(56) References Cited

U.S. PATENT DOCUMENTS 458,607 A * 9/1891 Weiss ..... 239/222.17
783,826 A * 2/1905 Dinkel ..... 239/523
1,272,274 A * 7/1918 Kinealy ..... 239/500
1,401,176 A * 12/1921 Miller et al. ..... 239/505
1,507,350 A * 9/1924 Franzen ..... 239/522
1,764,570 A * 6/1930 Lohman ..... 239/222.19
1,805,782 A * 5/1931 Munz ..... 239/498
2,194,375 A * 3/1940 Zimarik ..... 68/58
2,264,307 A * 12/1941 Haberstump ..... 68/58

(Continued)

FOREIGN PATENT DOCUMENTS

DE 43 30 079 * 3/1985

(Continued)

OTHER PUBLICATIONS

European Patent Office 0 252 323 Jun. 1987.*

(Continued)

*Primary Examiner*—Frankie L. Stinson
(74) *Attorney, Agent, or Firm*—McKenna Long & Aldridge LLP

(57) ABSTRACT

Disclosed is a washing machine having an improved circulation apparatus for pumping water in a lower side of the tub and discharging the pumped water from an upper side of the tub. The circulation apparatus includes a circulation motor, a circulation hose and an injection unit. The circulation motor communicates with a lower side of a tub of a washing machine to pump water in the tub. The circulation hose has one end that is connected with the circulation motor, and guides the pumped water. The injection unit includes a nozzle. that has a facing surface facing an inside of a drum and left and right surfaces of the facing surface, the facing surface and the left and right surfaces being completely opened. The nozzle disperses the water into the inside of the drum.

22 Claims, 4 Drawing Sheets

U.S. PATENT DOCUMENTS

| | | | | | |
|---|---|---|---|---|---|
| 2,289,889 | A | * | 7/1942 | Stick et al. | 239/273 |
| 2,296,257 | A | * | 9/1942 | Breckenridge | 68/24 |
| 2,338,273 | A | * | 1/1944 | Wilkins | 239/522 |
| 2,360,278 | A | * | 10/1944 | Robertson | 68/18 F |
| 2,625,031 | A | * | 1/1953 | Kreitchman | 68/139 |
| 2,631,448 | A | * | 3/1953 | Garman | 68/207 |
| 2,807,963 | A | * | 10/1957 | Osterhus et al. | 474/74 |
| 2,836,186 | A | * | 5/1958 | Guth | 134/57 D |
| 2,864,652 | A | | 12/1958 | O'Brien et al. | |
| 2,966,052 | A | * | 12/1960 | Syles | 68/58 |
| 3,121,317 | A | * | 2/1964 | Toma | 68/23.5 |
| 3,490,569 | A | * | 1/1970 | Reed | 192/18 R |
| 3,750,956 | A | * | 8/1973 | Mastman | 239/272 |
| 4,000,968 | A | * | 1/1977 | Schrage et al. | 8/158 |
| 4,168,033 | A | * | 9/1979 | von Bernuth et al. | 239/523 |
| 4,186,573 | A | * | 2/1980 | Brenner et al. | 68/12.18 |
| 4,320,072 | A | * | 3/1982 | Arndt | 261/111 |
| 4,754,622 | A | * | 7/1988 | Fanson | 68/207 |
| 5,226,203 | A | * | 7/1993 | Sacconato et al. | 8/159 |
| 5,860,300 | A | * | 1/1999 | Valent | 68/24 |
| 6,032,494 | A | * | 3/2000 | Tanigawa et al. | 68/12.06 |
| 6,205,603 | B1 | * | 3/2001 | Vande Haar | 8/159 |
| 6,691,536 | B2 | * | 2/2004 | Severns et al. | 68/12.27 |
| 2004/0117919 | A1 | * | 6/2004 | Conrad et al. | 8/137 |

FOREIGN PATENT DOCUMENTS

| | | | | |
|---|---|---|---|---|
| DE | 3811583 | | | 10/1989 |
| DE | 19500370 | | | 7/1996 |
| DE | 19500370 | A1 | | 7/1996 |
| JP | 46-044272 | | | 5/1971 |
| JP | 2001-009188 | | | 1/2001 |
| JP | 2001-9188 | | * | 1/2001 |
| KR | 1996-0034561 | | | 10/1996 |
| KR | 2002030585 | | * | 4/2002 |
| KR | 2004-0011307 | | | 2/2004 |

OTHER PUBLICATIONS

European Patent Office 0 610 876 Feb. 1994.*

* cited by examiner

WASHING MACHINE

This application claims the benefit of the Korean Application Nos. P2002-0045088 and P2002-0045090, both filed on Jul. 30, 2002, which is hereby incorporated by reference.

BACKGROUND OF THE INVENTION

1. Field of the Invention

The present invention relates to a washing machine, and more particularly, to a washing machine having an improved circulation apparatus for pumping water in a lower side of the tub and discharging the pumped water from an upper side of the tub.

2. Discussion of the Related Art

In general, a washing machine is an apparatus for eliminating contaminants from laundry by the interaction of detergent and water.

Washing machines are generally classified into agitator type, pulsator type, and drum type washing machines.

The agitator type washing machine washes laundry by rotating a washing rod overtopping at the center of the washing tub in left and right directions. The pulsator type washing machine washes laundry using the frictional force generated between water current and laundry by rotating the disk-shaped pulsator in right and left directions. The drum type washing machine washes laundry by loading water, detergent and laundry into a drum with a plurality of protruded tumbling ribs installed in an inner surface of the drum and rotating the drum at a low speed.

In recent years, in order to enhance the washing efficiency of the agitator type, pulsator type and drum type washing machines, a variety of auxiliary units are additively provided, such as a washing water circulation apparatus, for example. The washing water circulation apparatus allows objects to be washed received in the drum or washing tub to be wet rapidly, and enhances the washing efficiency by increasing the frictional force due to water current.

The washing water circulation apparatus is configured to pump water in an inner lower space of the tub and discharge the pumped water from the upper side to the inner space of the drum or washing tub. The washing water circulation apparatus has a plurality of small injection holes for injecting the pumped water into the inner space of the drum or the washing tub.

However, the water in the tub contains a considerable amount of foreign particles such as lint. Therefore, the foreign particles are pumped along with the water in the tub through the washing water circulation apparatus and then injected through the injection holes. Over a long period of time, the injection holes are choked with the foreign particles, causing problems in the washing machine.

In addition, because the water that is pumped through the washing water circulation apparatus is generally injected only in one direction, the pumped water cannot be uniformly injected into the washing objects received in the drum or washing tub.

Accordingly, all the washing objects cannot be rapidly wet, making it difficult to obtain high washing efficiency.

SUMMARY OF THE INVENTION

Accordingly, the present invention is directed to a washing machine that substantially obviates one or more problems due to limitations and disadvantages of the related art.

An advantage of the present invention is to provide an improved washing water circulation apparatus in which clogging due to lint is prevented.

Another advantage of the present invention is to provide an improved washing water circulation apparatus in which water is injected in various directions.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is provided a washing water circulation apparatus including a circulation motor, a circulation hose and an injection unit. The circulation motor communicates with a lower side of a tub of a washing machine to pump water in the tub. The circulation hose has one end that is connected with the circulation motor, and guides the pumped water. The injection unit includes a cylindrical connector and a nozzle. The cylindrical connector is installed between a door and the tub and provided so as to penetrate a gasket for preventing water leakage. One end of the cylindrical connector is connected with the circulation hose. The nozzle is provided below the gasket. The nozzle has a facing surface facing an inside of a drum and left and right surfaces of the facing surface, the facing surface and the left and right surfaces being completely opened. The nozzle disperses the water, which is discharged to a lower side from the cylinder, into the inside of the drum to inject the dispersed water.

The present invention is not limited to cylindrical connectors, rather the connectors can have a variety of cross-sectional shapes, such as a square or triangle.

Alternatively, the washing water circulation apparatus of the present invention may be configured to further include an annular rib extending from one side surface of the gasket so as to hold and support an outer surface of the connector.

The connector may further include a projection protruded from an outer circumference of the connector for preventing the connector from dropping under the gasket.

In the washing water circulation apparatus according to the present invention, the injection unit may be comprised of a single body. In this case, the nozzle includes: an upper horizontal part extending from the other end toward the drum; a vertical part extending from an opposite side to a side facing the drum to a lower side; and a lower horizontal part extending from a lower end toward the drum.

Herein, the upper horizontal part has an upper surface, which is supported close to the gasket. The vertical part has a center portion that is formed convex toward the drum. The lower horizontal part has a center portion, which is formed convex upward. The lower horizontal part comprises a guide groove formed in left and right directions. The lower horizontal part has an upper surface inclined downward as it travels from the guide groove toward the drum.

Furthermore, in the washing water circulation apparatus of the present invention, the connector and the nozzle of the injection unit are formed separately from each other. In this case, the connector is formed of an independent single body, and the nozzle is formed extending from the gasket. The nozzle comprises: a vertical part extending downward from a lower surface of the gasket; and a lower horizontal part extending from a lower end of the vertical part toward the drum. The vertical part has a center portion, which is formed convex toward the drum. The lower horizontal part has a center portion, which is formed convex upward. The lower horizontal part comprises a guide groove, which is formed in left and right directions. The lower horizontal part has an upper surface inclined downward as it travels from the guide groove toward the drum.

In another aspect of the present invention, there is provided a washing machine provided with the washing water circulation apparatus. The washing machine includes: a case; an outer tub provided within the case and storing water therein; an inner tub provided rotatable within the outer tub and having a plurality of holes communicating with an inner space of the outer tub; and the washing water circulation apparatus mentioned above.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principle of the invention.

In the drawings.

DETAILED DESCRIPTION OF THE ILLUSTRATED EMBODIMENTS

Reference will now be made in detail to an embodiment of the present invention, example of which is illustrated in the accompanying drawings. Wherever possible, the same reference numbers will be used throughout the drawings to refer to the same or like parts, and additional description thereof is omitted.

Figure 1:
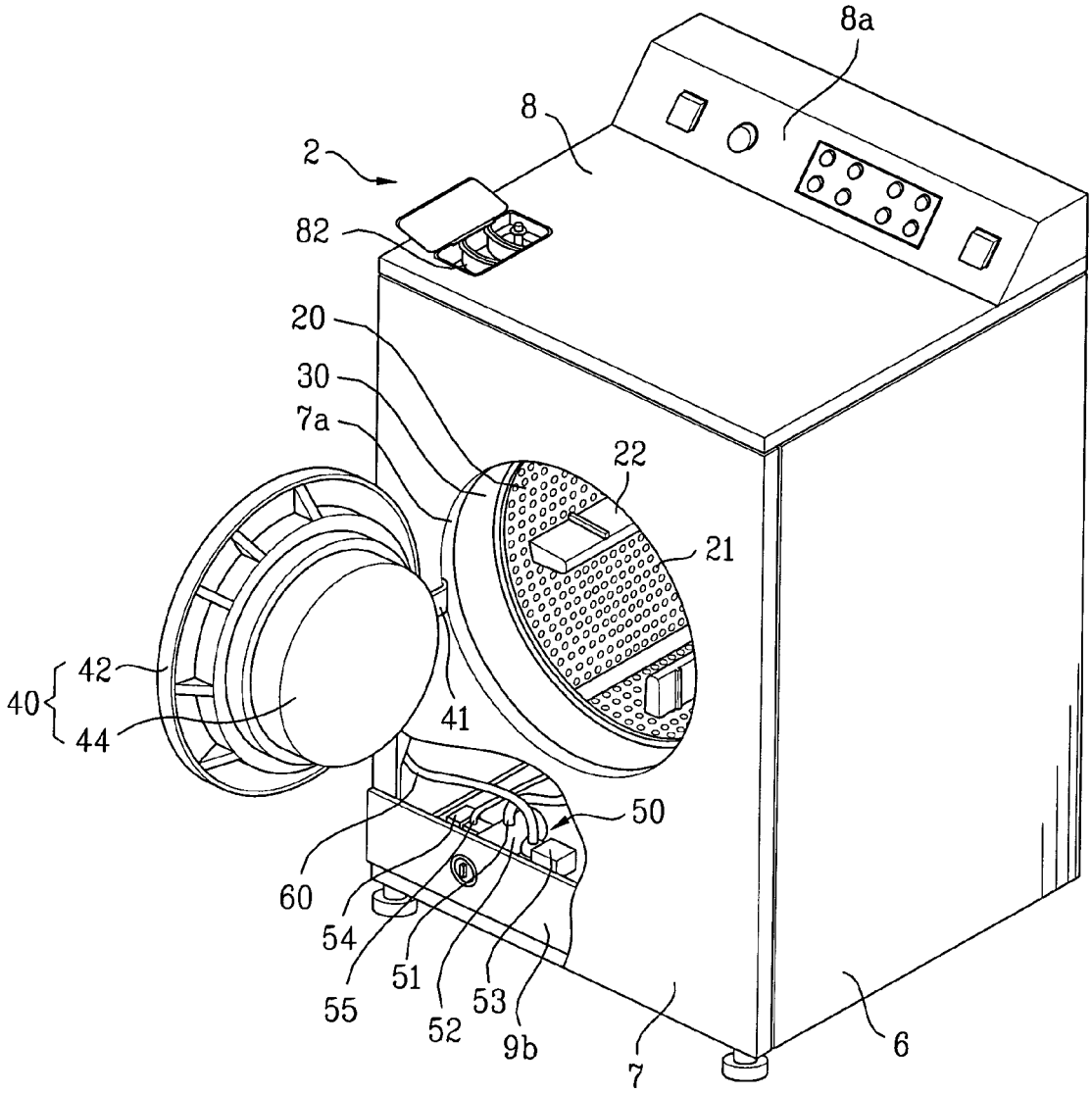
FIG. 1 is a partial cut-away perspective view of a washing machine according to the present invention.
Figure 2:
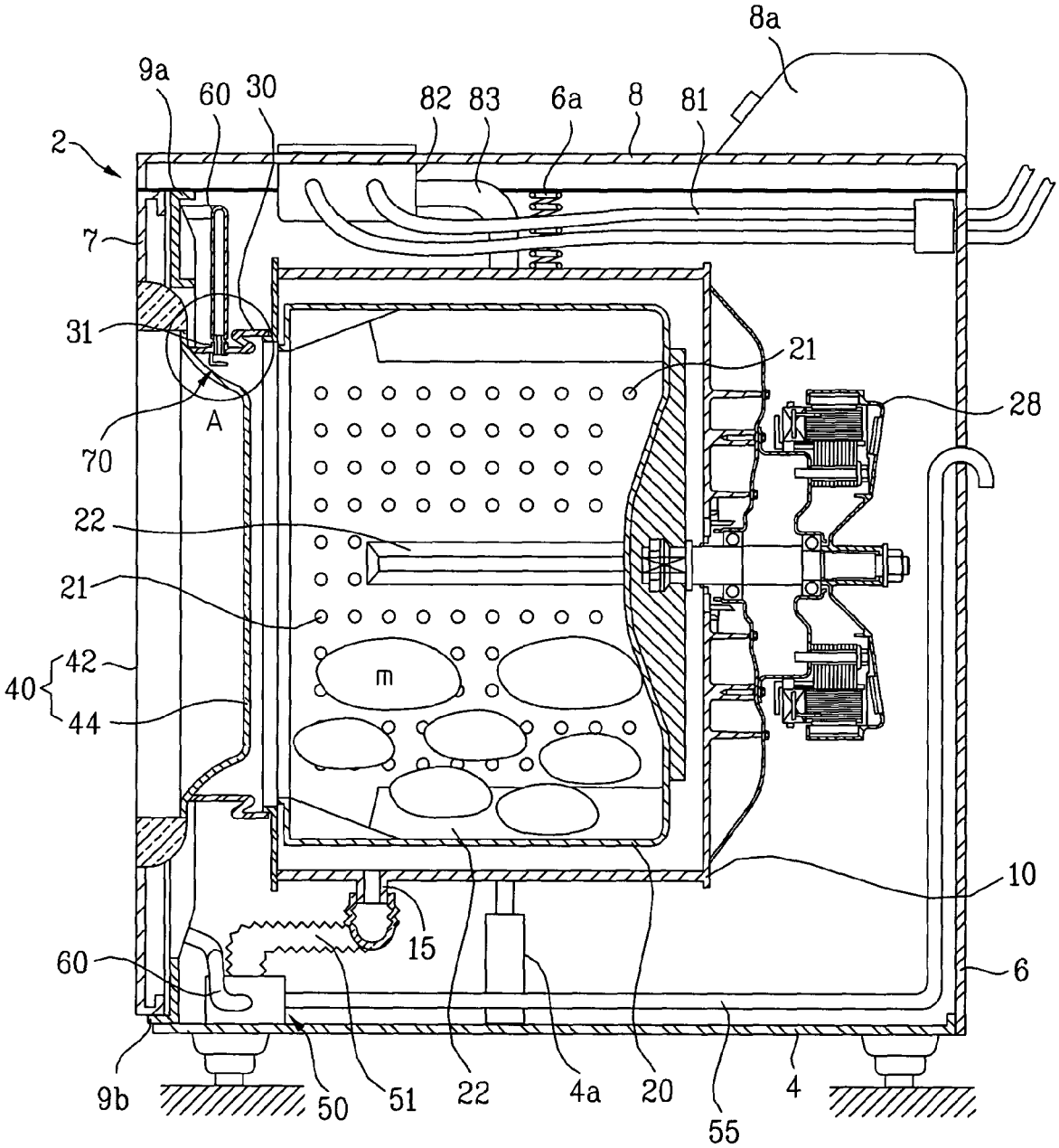
FIG. 2 is a sectional view of a washing machine according to the present invention.

FIG. 1 is a partial cut-away perspective view of a washing machine according to the present invention, and FIG. 2 is a sectional view of a washing machine according to the present invention. FIGS. 1 and 2 illustrate a drum type washing machine in which an outer tub installed in a case and an inner tub installed rotatably in the outer tub are side-opening. However, the present invention is not limited to the illustrated drum type washing machine but can be equally applied to the pulsator type washing machine or a similar machine in which the outer tub and the inner tub are top-opening.

Hereinafter, construction of the washing machine according to the present invention will be described in more detail with reference to the above drawings. For the convenience of description, the outer tub is referred to as 'tub' and the inner tub is referred to as 'drum'.

Referring to FIGS. 1 and 2, a case 2 of the washing machine includes a base 4, a cabinet 6 and a top plate 8.

The base 4 constitutes the bottom of the case 2. On the base, a damper 4*a* for supporting a tube 10 to be described later is mounted.

The cabinet 6 stands on the base 4 so as to form therein a space where the tub 10 can be installed. On an inner surface of the cabinet 6, springs 6*a* holding and supporting the tub 10 are connected. In any surface of the cabinet 6 such as the front surface, for example, a loading hole 7*a* is formed through which laundry (100) is loaded or unloaded. At front, inner, upper and lower sides of the cabinet 6, an upper frame 9*a* and a lower frame 9*b* are horizontally arranged as shown in FIG. 2.

The door 40 is installed at a front side of the cabinet 6 so as to open and close the loading hole 7*a*. This door 40 is configured to include a door frame 42 and a door glass 44. The door frame 42 is hinge-coupled at the front side of the cabinet and has a hole formed in the center in which the door glass 44 is installed.

The top plate 8 is mounted on the opened cabinet 6 to seal an inner space formed by the cabinet 6 and the base 4. On a predetermined portion of the top plate 8, a control panel 8*a* for manipulating the washing machine is equipped.

In the inner space of the case 2, the tub 10 is provided. As described above, the tub 10 is located at a mid portion of the inner space and supported by the springs 6*a* and the damper 4*a*. The tub 10 is installed such that the opened front thereof faces the loading hole 7*a* of the cabinet 6. In the tub 10 installed as above, water is supplied and stored.

In the inner space of the tub 10, a drum 20 is rotatably installed. For this purpose, a motor 28 is installed in the cabinet 6 so as to rotate the drum 20. In FIG. 2, there is shown an embodiment in which the shaft of the motor 28 is directly coupled to the drum 20. In this case, the shaft penetrates the tub 10. In addition, although not shown in the drawings, the motor 28 may rotate the drum 20 indirectly. In such a case, the drum 20 and the motor 28 can be connected by a belt, for instance.

A plurality of water holes 21 are formed in the drum 20. Hence, water stored in the tub 10 comes in and out the inner space of the drum 20 through the water holes 21. On an inner circumference of the drum 20, a plurality of tumbling ribs 22 are protruded as shown in FIGS. 1 and 2. The tumbling ribs 22 raise and drop the laundry (100) while the drum 20 is rotated.

Between the door 40 and the tub 10, a gasket 30 is installed as shown in FIG. 2. The gasket 30 prevents water and laundry (100) received in the drum 20 and the tub 10 from being leaked outside the tub 10 and being introduced into the inner space of the cabinet 6. In the meanwhile, on the gasket 30, an insertion hole 31 is formed such that an injection unit 70 to be described later is inserted and equipped. An annular rib extends from the gasket 30 toward an upward direction of the insertion hole 31.

At a lower portion of the tub 10, a drain 15 is formed. A drain bellows tube 51 is connected with the drain 15. A pump unit 50 for pumping the water introduced through the drain 15 and the drain bellows tube 51 and draining the pumped water, or circulating the pumped water into the inside of the drum 20 again is connected to the drain bellows tube 51.

The pump unit 50 is configured to include a pump case 52, a circulation pump 53 and a drain pump 54. Water passing through the drain 15 and the drain bellows tube 51 is introduced into the pump case 52. A drain hose 55 communicating with an outside is connected with the drain pump 54. The drain pump 54 drains the water introduced into the pump case 52 in the drain process of the washing machine to an outside through the drain hose 55. A circulation hose 60 is connected to the circulation pump 53. The circulation hose 60 is arranged so that one end is adjacent to the upper side of the gasket 30. Hence, the circulation pump 53 allows the water to be introduced into the pump case 52 via the circulation hose 60.

In the aforementioned drawings, reference numeral 81 indicates a water feed hose for supplying external clean water to the washing machine, and reference numeral 82 indicates a detergent box. The detergent box 82 functions to mix the water supplied through the water feed hose 81 with previously stored detergent. Reference numeral 83 indicates a feed bellows tube for guiding water discharged from the detergent box 82 to the inside of the tub 10.

The injection unit 70 is inserted into the insertion hole 31 and a rib 32 of the gasket 30. One end of the injection unit 70 is connected with the circulation hose 60 and the other end thereof penetrates the gasket 30 and is located under the gasket 30. The injection unit 70 installed as above disperses and discharges the water via the circulation hose 60 into the inner space of the drum 20. Hereinafter, such a construction will be described in more detail with reference to the accompanying drawings.

Figure 3:
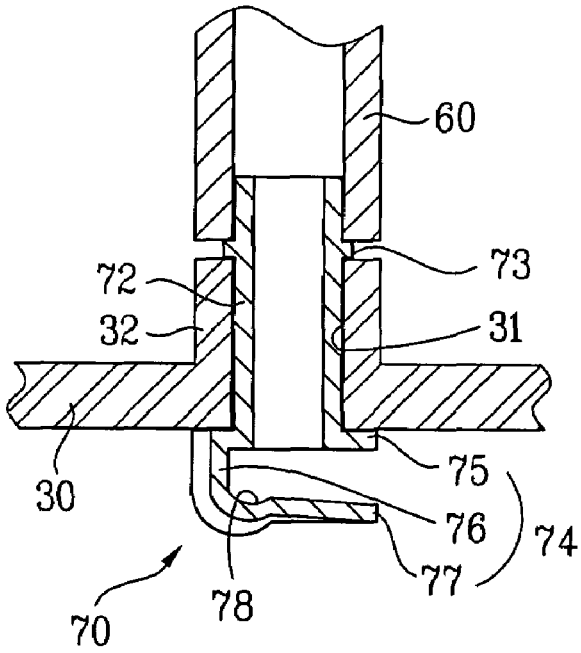
FIG. 3 is a partial sectional view illustrating an embodiment of a washing water injection unit in a washing machine according to the present invention.
Figure 4:
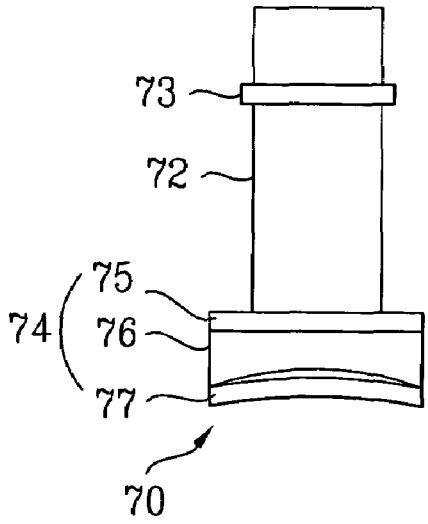
FIG. 4 is a front view of the injection unit of FIG. 3.
Figure 5:
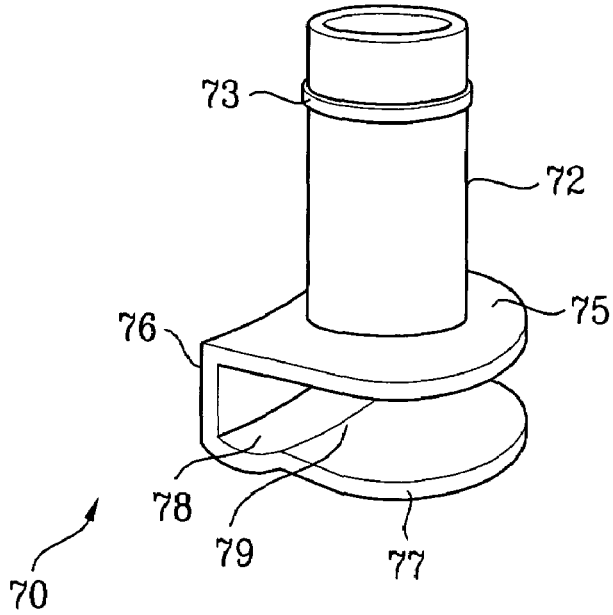
FIG. 5 is a perspective view of the injection unit of FIG. 3.

FIG. 3 is a partial sectional view illustrating an embodiment of a washing water injection unit in a washing machine according to the present invention, FIG. 4 is a front view of the injection unit of FIG. 3, and FIG. 5 is a perspective view of the injection unit of FIG. 3.

Referring to FIG. 3, the injection unit 70 is configured to include a cylindrical connector 72 connected with the circulation hose 60, and a nozzle 74 provided below the gasket 30, for dispersing the water discharged downward from the connector 72 into the inner space of the drum 20 and draining the dispersed water. In the embodiment shown in FIGS. 3 to 5, the connector 72 and the nozzle 74 are continuously formed as a single body and equipped in the gasket 30.

One end of the connector 72 is, as shown in FIG. 3, connected with an end of the circulation hose 60 and the other end thereof is inserted into and equipped in the insertion hole 31 and the rib 32 of the gasket 30. Here, the rib 32 holds and stably supports an outer surface of the connector 72.

In addition, on an outer circumference of the connector 72, an annular projection 73 is protruded as shown in FIG. 3. The projection 73 is supported by an upper side of the rib 32. Hence, the connector 72 inserted into the insertion hole 31 is prevented from dropping downward by the weight of the connector itself, water flow or external vibration. The connector 72 constructed as above is forcibly inserted upward from a lower side of the gasket 30 through the insertion hole during its installation.

The nozzle 74 is provided below the gasket 30. A surface of the nozzle 74 facing the inside of the drum 20 and left and right surfaces thereof are completely opened. The nozzle 74 constructed as above disperses water discharged downward from the connector 72 into the inside of the drum 20 through the facing surface and the left and right surfaces of the nozzle 74 and discharges the dispersed water. Hereinafter, for the convenience of description, a side where the drum 20 is located is referred to as 'rear side of the nozzle 74' and a side where the door 40 is located is referred to as 'front side of the nozzle 74'.

The aforementioned nozzle 74 includes an upper horizontal part 75, a vertical part 76, and a lower horizontal part 77.

The upper horizontal part 74, as shown in FIG. 3, extends wider at the other end of the connector 72. This upper horizontal part 75, for instance, extends toward the drum 20 and its upper surface is closely contacted with the lower surface of the gasket 30.

The vertical part 76 extends with a predetermined length downward from the front side of the upper horizontal part, i.e., an opposite side to the side facing the drum 20.

The lower horizontal part 77 extends toward the rear side, i.e., toward the drum 20 from the lower side of the vertical part. Hence, as shown in FIGS. 3 and 5, the upper horizontal part and the lower horizontal part 77 are arranged parallel to each other with being spaced apart by a predetermined distance from each other. Also, by the above construction, the rear side of the nozzle 74, i.e., a direction facing the drum 20 and its left and right directions are all completely opened.

In the nozzle 74 constructed as above, the vertical part 76 has a center portion, which is formed convex toward the front side, i.e., toward the drum 20 with respect to both sides of the left and right, as shown in FIGS. 3 to 5. If the vertical part 76 is formed as above, it is possible to easily disperse the water, which is dropped downward from the connector 72 and is splashed by the lower horizontal part, in both side directions of the left and right.

As shown in FIGS. 3 and 4, the lower horizontal part 77 has a center portion, which is formed convex upward, i.e., toward the connector 72 with respect to both sides of the left and right. By doing so, it becomes possible to easily disperse the water, which is dropped downward from the connector 72, in both side directions of the lower horizontal part 77.

In addition, a guide groove 78 is formed in the lower horizontal part 77. The guide groove 78 is, as shown in FIGS. 3 to 5, provided adjacent to a portion where the lower horizontal part 77 and the vertical part 76 are connected. Thus, if the guide groove 78 is provided in the lower horizontal part 77, a certain amount of the water dropped downward from the connector 72 is secured, so that it becomes possible to disperse the secured water in the left and right directions.

As shown in FIGS. 3 and 4, the upper surface of the lower horizontal part 77 is formed inclined downward as it travels from the guide groove 78 to the drum 20. If the lower horizontal part 77 is formed as above, it is possible to easily discharge a part of the water dropped through the connector 72 toward the opened front side of the nozzle 74.

Figure 6:
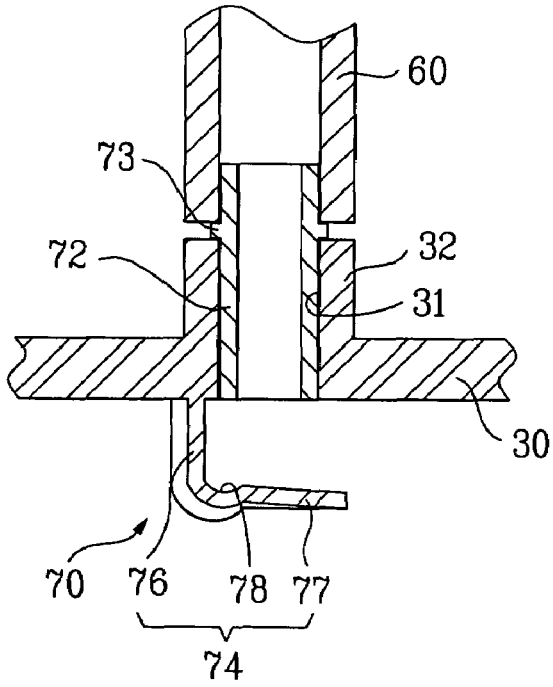
FIG. 6 is a partial sectional view illustrating another embodiment of a washing water injection unit in a washing machine according to the present invention.

In the meanwhile, as shown in FIG. 6, the present invention also discloses an embodiment in which connector and nozzle are formed separately. FIG. 6 is a partial sectional view illustrating another embodiment of a washing water injection unit in a washing machine according to the present invention.

Hereinafter, another embodiment of the injection unit will be described in more detail with reference to FIG. 6. In describing the present embodiment, the same elements as those of the embodiments described with reference to FIGS. 3 to 5 will be used throughout the drawings to refer to the same or like parts.

In the embodiment shown in FIG. 6, the connector 72 and the nozzle 74 constituting the injection unit 70 are made in a separate structure. The connector 72 is formed in an independent single body structure, and the nozzle 74 is formed extending downward from the gasket 30.

As shown in FIG. 6, the connector 72 is formed in a cylindrical shape. On the main outer surface of the connector 72, a projection 73 is formed to prevent the connector 72 from deviating downward from the insertion hole 31 and the rib 32. The connector 72 formed as above is installed and equipped penetrating the insertion hole 31 and the rib 32 from the upper side to the lower side of the gasket 30, and one end of the connector 72 is connected with one end of the circulation hose 60.

The nozzle 74 is configured to include a vertical part 76 and a lower horizontal part. The vertical part 76 extends downward from the lower surface of the gasket 30. Also, the lower horizontal part 77 extends from the lower end to the rear side of the vertical part, i.e., toward the inside of the drum 20.

The nozzle 74 in the embodiment shown in FIG. 6 is also shaped to have completely opened rear side and left and right sides like the embodiment described with reference to FIGS. 3 to 5. Hereinafter, to avoid repeated description, the description related with the shape of the nozzle 74 will be omitted.

As aforementioned, the inventive injection unit 70 shown in FIG. 6 is characterized in that the connector 72 and the nozzle 74 are formed in a separate structure unlike the embodiment described with reference to FIGS. 3 to 5. In order to provide a more simplified structure, the nozzle 74 is characterized in that it is formed extending from the lower surface of the gasket 30.

Hereinafter, operations of the washing machine and the washing water circulation apparatus will be described.

A user opens the door 40 and loads laundry (100) into the inside of the drum 20. As the door 40 is closed and the washing machine is operated, external water is fed to the detergent box 82 through the water feed hose 81. The detergent prepared in advance in the detergent box 82 is dissolved by supplied water, and the water in which detergent is dissolved is fed to the tub through the feed bellows tube 83.

Once a certain amount of water is supplied to the tub 10, the drum 20 is rotated by the motor 28. The water stored in the tub 10 is naturally introduced into the drum 20 through water holes 21. If the drum 20 is rotated, the laundry (100) is raised by the tumbling ribs 22 and then dropped. Hence, due to the chemical interaction of the detergent, impact energy of when water is dropped by the tumbling ribs 22, frictional force of water current generated by the rotation of the drum 20, and the like, contaminant is separated from the laundry (100) to perform the washing.

Meanwhile, while the washing process is performed with the rotation of the drum 20, the circulation pump 53 is operated. The circulation pump 53 pumps the water, which was introduced into the pump case 52 through the drain 15 and the drain bellows tube 51 arranged below the tub 10, from the tub 10 to the circulation hose 60.

The pumped water is introduced into the connector 72 of the injection unit 70 via the circulation hose 60, and is then dropped to the lower horizontal part 77 of the nozzle 74 through the connector 72. At this time, the rear side and the left and right directions of the nozzle 74 are completely opened. Hence, water is uniformly dispersed in the left and right directions and the rear side by guidance of the vertical part 76, guide groove 78 and lower horizontal part 77, and then discharged to the inside of the drum 20.

The uniformly dispersed and discharged water rapidly wets the laundry (100) received in the drum 20 in an initial stage of the washing process. While the washing is performed, friction and impact energies due to the drop of water are uniformly transferred to the laundry (100) to thereby obtain uniform washing capability.

After the washing process is performed with the drum 20 being rotated for a certain time, the drum 20 and the circulation pump 53 are stopped. After the washing process is completed, the contaminated water is drained to the outside. In the drain process, the drain pump 54 is operated and the water in the tub 10 is discharged to the outside through the drain hose 55.

After the drain process is completed, the drain pump 54 is stopped, new water is fed to the inside of the tub 10 and the drum 20 is rotated to perform rinsing process. During the rinsing process, the drum 20 is rotated and the circulation pump 53 is operated to perform the rinsing process through a similar process with the washing process.

After the washing of the laundry (100) completed by the repeating rinsing and draining processes, the laundry (100) is dewatered by rotating the drum 20 at a high speed. Meanwhile, if a case heater, blower and the like are provided in the washing machine, dewatered laundry is completely dried using hot air.

The washing machine according to the present invention has the following advantages.

First, if the washing machine of the present invention is used, the blockage or clogging of the circulation passage by lint or debris can be prevented. In other words, because the nozzle 74 that discharges the circulating washing water is completely opened in the rear side, and disperses water in the left and right directions, unlike the conventional structure having a small opening, even though the washing machine is used for a very long period of time, the blockage or clogging of the nozzle 74 by lint are prevented.

Second, if the inventive washing machine is used, washing performance can be improved and uniform washing result can be obtained in successive washings. In other words, the washing water passing through the circulation hose 60 is uniformly dispersed in the rear side and the left and right directions from the nozzle 74 and is discharged into the drum 20, so that laundry is rapidly wet in an initial stage of the washing process. As a result, substantial washing time is lengthened and thus the washing performance is enhanced. Also, since energy due to the water dropping from the nozzle 74 for a long-term period is uniformly transferred, a uniform washing result can be obtained with respect to all the laundry.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A washing water circulation apparatus, comprising:

a circulation motor communicating with a lower side of a tub of a washing machine, for pumping water in the tub;

a circulation hose of which one end is connected with the circulation motor, for guiding the pumped water; and an injection unit including a connector of which one end is connected with the circulation hose, and a nozzle provided below a gasket, the connector being installed between a door and the tub and provided so as to penetrate the gasket for preventing water leakage, and the nozzle having a facing surface facing an inside of a drum, said facing surface having left and right surfaces, the facing surface and the left and right surfaces are configured such that water is dispersed in a plurality of substantially horizontal directions into the inside of the drum, wherein, the nozzle comprises an upper horizontal part extending from one end toward the drum, wherein the upper horizontal part has an upper surface, which is supported closely to the gasket; a vertical part extending from an opposite side to a side facing the drum to a lower side; and a lower horizontal part extending from a lower end toward the drum.

2. The washing water circulation apparatus of claim 1, further comprising an annular rib extending from a side surface of the gasket so as to hold and support an outer surface of the connector.

3. The washing water circulation apparatus of claim 1, wherein the connector further comprises a projection protruding from an outer circumference of the connector, for preventing the connector from dropping under the gasket.

4. The washing water circulation apparatus of claim 1, wherein the injection unit is comprised of a single body.

5. The washing water circulation apparatus of claim 1, wherein the vertical part has a center portion having a convex shape opening toward the drum.

6. The washing water circulation apparatus of claim 1, wherein the lower horizontal part has a center portion having a convex shape opening upward.

7. The washing water circulation apparatus of claim 1, wherein the lower horizontal part comprises a guide groove extending in left and right directions.

8. The washing water circulation apparatus of claim 7, wherein the lower horizontal part has an upper surface inclined downward from the guide groove toward the drum.

9. The washing water circulation apparatus of claim 1, wherein the connector and the nozzle of the injection unit are separate from each other.

10. The washing water circulation apparatus of claim 9, wherein the connector is a single body, and the nozzle extends from the gasket.

11. The washing water circulation apparatus of claim 10, wherein the nozzle comprises:

a vertical part extending downward from a lower surface of the gasket; and a lower horizontal part extending from a lower end of the vertical part toward the drum.

12. The washing water circulation apparatus of claim 11, wherein the vertical part has a center portion having a convex shape opening towards the drum.

13. The washing water circulation apparatus of claim 11, wherein the lower horizontal part has a center portion having a convex shape opening upward.

14. The washing water circulation apparatus of claim 11, wherein the lower horizontal part comprises a guide groove extending in left and right directions.

15. The washing water circulation apparatus of claim 14, wherein the lower horizontal part has an upper surface inclined downward from the guide groove toward the drum.

16. A washing machine, comprising:

a case:

an outer tub provided within the case and storing water therein;

an inner tub provided rotatable within the outer tub and having a plurality of holes communicating with an inner space of the outer tub;

a circulation motor communicating with a lower side of the outer tub, for pumping the water in the outer tub;

a circulation hose of which one end is connected with the circulation motor, for guiding the pumped water; and an injection unit including a connector of which one end is connected with the circulation hose, and a nozzle provided below a gasket, the connector being installed between a door and the tub and provided so as to penetrate the gasket for preventing water leakage, and the nozzle having a facing surface, said facing surface facing the inner tub and having left and right surfaces, the facing surface and the left and right surfaces are configured such that water is dispersed in a plurality of substantially horizontal directions from the nozzle into the inner tub, wherein the nozzle comprises an upper horizontal part extending from the other end toward the drum; a vertical part extending from an opposite side to a side facing the drum to a lower side; and a lower horizontal part extending from a lower end toward the drum.

17. The washing machine of claim 16, wherein the vertical part has a center portion having a convex shape opening toward the drum, and the lower horizontal part has a center portion having a convex shape opening upward.

18. The washing machine of claim 16, wherein the lower horizontal part comprises a guide groove extending in left and right directions, and the lower horizontal part has an upper surface inclined downward from the guide groove toward the drum.

19. A washing machine comprising:

a case:

an outer tub provided within the case and storing water therein;

an inner tub provided rotatable within the outer tub and having a plurality of holes communicating with an inner space of the outer tub;

a circulation motor communicating with a lower side of the outer tub, for pumping the water in the outer tub;

a circulation hose of which one end is connected with the circulation motor, for guiding the pumped water; and an injection unit including a connector of which one end is connected with the circulation hose, and a nozzle provided below a gasket, the connector being installed between a door and the tub and provided so as to penetrate the gasket for preventing water leakage, and the nozzle having a facing surface, said facing surface facing the inner tub and having left and right surfaces, the facing surface and the left and right surfaces are configured such that water is dispersed in a plurality of substantially horizontal directions from the nozzle into the inner tub, wherein the nozzle comprises:

a vertical part extending downward from a lower surface of the gasket; and a lower horizontal part extending from a lower end of the vertical part toward the drum.

20. The washing machine of claim 19, wherein the vertical part has a center portion having a convex shape opening toward the drum, and the lower horizontal part has a center portion having a convex shape opening upward.

21. The washing machine of claim 19, wherein the lower horizontal part comprises a guide groove extending in left and right directions, and the lower horizontal part has an upper surface inclined downward from the guide groove toward the drum.

22. A washing machine, comprising:

a cabinet:

an outer tub provided within the cabinet and storing water therein;

an inner tub provided rotatable within the outer tub and having a plurality of holes communicating with an inner space of the outer tub;

a circulation motor that pumps the water in the outer tub, wherein the circulation motor communicates with a lower side of the outer tub;

a circulation hose that guides the pumped water, wherein one end of the circulation hose is connected with the circulation motor;

a gasket that prevents water leakage into the cabinet; and an injection unit comprising:

a connector, wherein a first end of the connector is connected to the circulation hose and a second end of the connector penetrates the gasket, and a nozzle positioned below the gasket, wherein the nozzle is configured such that water is dispersed in a plurality of substantially horizontal directions into the inner tub and the nozzle comprises: a vertical part extending downward from a lower surface of the gasket; and a lower horizontal part extending from a lower end of the vertical part toward the drum.

* * * * *